US008023846B2

(12) United States Patent
Tombs et al.

(10) Patent No.: US 8,023,846 B2
(45) Date of Patent: Sep. 20, 2011

(54) SEGMENTED ROLLER FOR FLOOD COATING SYSTEM

(75) Inventors: Thomas N. Tombs, Rochester, NY (US); Donna P. Suchy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 60 days.

(21) Appl. No.: 11/759,406

(22) Filed: Jun. 7, 2007

(65) Prior Publication Data

US 2008/0304846 A1 Dec. 11, 2008

(51) Int. Cl.
*G03G 15/06* (2006.01)

(52) U.S. Cl. ..... 399/55

(58) Field of Classification Search ..... 399/55, 399/302, 308, 286, 285; 427/511
See application file for complete search history.

(56) References Cited

U.S. PATENT DOCUMENTS

| | | | | |
|---|---|---|---|---|
| 3,383,697 | A | | 5/1968 | Rice et al. |
| 4,078,929 | A | | 3/1978 | Gundlach |
| 5,012,287 | A | | 4/1991 | Knapp |
| 5,102,765 | A | | 4/1992 | McCabe et al. |
| 5,102,767 | A | | 4/1992 | Chowdry et al. |
| 5,234,783 | A | * | 8/1993 | Ng ..... 430/45.53 |
| 5,594,534 | A | * | 1/1997 | Genovese ..... 399/285 |
| 5,612,777 | A | * | 3/1997 | Malhotra ..... 399/226 |
| 5,689,787 | A | * | 11/1997 | Tombs et al. ..... 399/308 |
| 5,701,564 | A | * | 12/1997 | Parker ..... 399/285 |
| 5,737,677 | A | | 4/1998 | Tombs et al. |
| 5,822,652 | A | * | 10/1998 | Elhatem et al. ..... 399/90 |
| 5,920,750 | A | * | 7/1999 | Wayman et al. ..... 399/90 |
| 5,968,607 | A | * | 10/1999 | Lovison ..... 427/511 |
| 6,098,546 | A | * | 8/2000 | Schell ..... 101/492 |
| 6,167,224 | A | * | 12/2000 | Dalal ..... 399/222 |
| 6,321,055 | B1 | * | 11/2001 | Mashtare et al. ..... 399/266 |
| 7,058,348 | B2 | * | 6/2006 | Aslam et al. ..... 399/341 |
| 7,236,734 | B2 | | 6/2007 | Ng et al. |
| 2004/0208678 | A1 | * | 10/2004 | Yoda et al. ..... 399/302 |
| 2005/0215406 | A1 | * | 9/2005 | Yock ..... 493/320 |
| 2006/0198660 | A1 | * | 9/2006 | Bessho ..... 399/223 |
| 2006/0285890 | A1 | * | 12/2006 | Ng ..... 399/329 |
| 2007/0070503 | A1 | * | 3/2007 | Boswell et al. ..... 359/566 |

FOREIGN PATENT DOCUMENTS

| | | |
|---|---|---|
| EP | 1321197 | 6/2003 |
| JP | 57111568 | 7/1982 |
| JP | 60241069 | 11/1985 |

* cited by examiner

*Primary Examiner* — Quana M Grainger
(74) *Attorney, Agent, or Firm* — Donna P. Suchy

(57) ABSTRACT

An electrostatographic apparatus and method of forming a toner image on a receiver using a segmented roller in order to improve transfer of a pigmented toner image to a receiver. The pigmented toner image is applied using the segmented roller and is then transferred to a receiver sheet.

6 Claims, 5 Drawing Sheets

SEGMENTED ROLLER FOR FLOOD COATING SYSTEM

FIELD OF THE INVENTION

The invention relates generally to electrostatography and more particularly to apparatus and methods for improving the electrostatic transfer of dry toner particles.

BACKGROUND OF THE INVENTION

In color electrophotography, sequential transfers of individual color separation toner images build up a full color image. The nature of the electrophotographic technology allows sequential images to vary in content. Often it is desirable to put a protective clear layer on top of the image to make the image more durable. In the Kodak NexPress 2100 a $5^{th}$ imaging module is used to apply a clear toner on top of a 4-color image in-line with the rest of the imaging process. In the Xerox iGen3 an inline coating apparatus is used to apply a clear overcoat on top of a 4-color image. In both of these devices the clear layer can also be applied in an image-wise fashion so as to create watermarks. In the Kodak device the clear imaging unit allows every sheet to vary in the placement of the clear layer, that is, the clear layer can be a different watermark for every sheet and can also vary between a watermark and a full clear coating. In the Xerox device the clear layer can not vary from image to image. Both of these devices require expensive additional hardware to enable the in-line capability to apply a clear layer, thus there remains a need to enable a low cost method of applying a clear layer on top of an image produced with an electrographic machine. An additional need is a low-cost method to apply a clear layer that can be varied in content from sheet to sheet.

The uses of clear, non-marking toner layers have been described in the prior art, for example in U.S. Pat. No. 5,737,677, filed in the names of Tombs et al., the contents of which are incorporated herein by reference, as aids to improved transfer, especially for high quality color electrophotography. They indicate that a clear toner underlay improves transfer efficiency over the whole gamut of toner layer thickness (optical density).

Still other apparatus for improving transfer with clear toner are described by Chowdry et al in U.S. Pat. Nos. 5,102,765 and 5,102,767. In Chowdry et al clear toner is transferred to a receiver and preferably fixed to the receiver. Thermal assisted transfer is then used to transfer a marking particle image onto the receiver which includes the clear fixed toner overlay. The role of the clear or uncolored toner layer is to serve as a thermoplastic layer so as to augment thermally assisted transfer of the marking particles.

SUMMARY OF THE INVENTION

In the present invention, a toner image is applied selectively using a segmented roller. This allows for flood coating substrates of various widths without the need for a full imaging system. In addition to coating the entire surface of the substrate, smaller regions can also be coated as long as they are composed of rectangular regions no larger than the width of the segments.

BRIEF DESCRIPTION OF THE DRAWINGS

The subsequent description of the various exemplary embodiments of the present invention will make reference to the attached drawings wherein.

DETAILED DESCRIPTION OF THE INVENTION

The apparatus and method of this invention can be an electrostatographic apparatus and method in general, but are preferably an electrophotographic apparatus and method, and most preferably a multi-color apparatus and method.

The term "primary imaging member" refers to a member onto which an electrostatic image is formed, such as, photoconductive elements, dielectric elements and electrographic masters. The term "bias development", as used herein, means developing with charged toner particles from a development station biased with a voltage to urge the toner particles to a member, for example, an intermediate transfer member (ITM) or a primary imaging member. The member can also be biased with a voltage to urge the toner particles from the development station to the member. The term "monolayer", as used herein, means a substantially full coverage of toner particles making up a single layer such that the addition of more toner particles forms a second layer of toner. Note that a mono layer is defined as a layer of 1 in "color height" such that it is a layer of 1 color but not limited to a particular density or packing fraction and thus does not necessarily cover the entire receiver.

The term "toner size" or "toner diameter", as used herein, or the term "size", or "sized" as employed herein in reference to the term "particles", unless otherwise indicated, means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "receiver" as used herein refers to a substrate upon which a toner image is transferred and subsequently heat fused or otherwise fixed to produce a final image. Examples of suitable receivers include paper, metal and plastic film such as films of polyethylene terephthalate, polycarbonate, or the like, which are preferably transparent and therefore useful in making transparencies. The receiver is preferably in the form of a discrete receiver sheet but a continuous receiver is also envisioned.

The term "image-wise" as used herein means corresponding to a desired toner image to be produced. The term "non-image-wise" means not containing any information corresponding to a desired final toner image to be produced. Typically a non-image-wise lay-down of non-marking toner means a substantially uniform flat-field deposit. The term "support member" may refer to a primary imaging member or to an intermediate transfer member and may be either a drum or a web.

Figure 1:
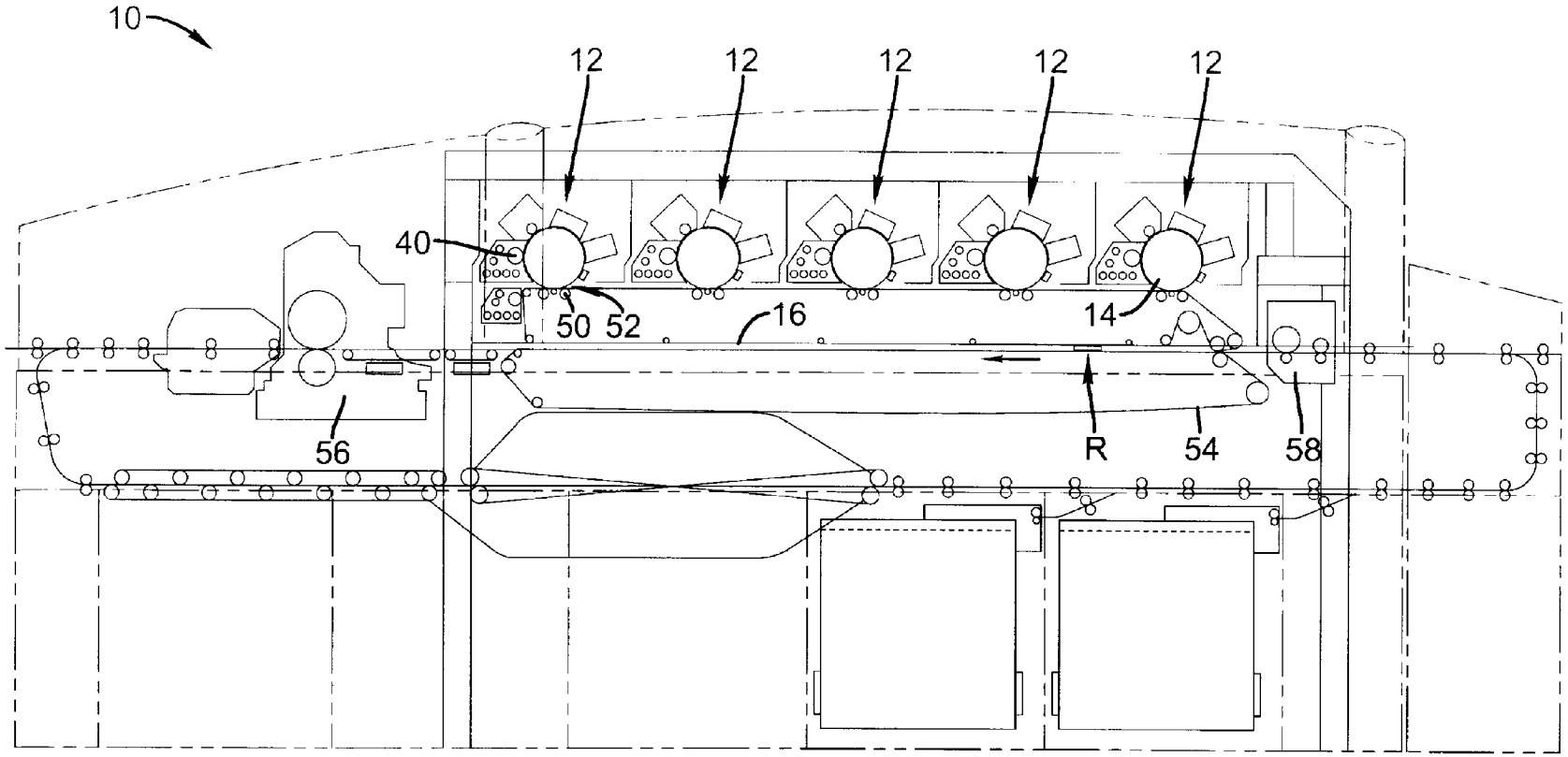
FIG. 1 is a side elevation view in schematic form of an electrophotographic recording apparatus in accordance with a first embodiment of the invention.

In the apparatus and method of this invention, as shown in FIG. 1, more than one imaging module or member 12, as defined above, can be used. Typically, an apparatus for making single color final toner images has a single primary imaging member 14, and an apparatus for making multi-color final toner images has either one or more than one primary imaging members 14. In some embodiments of the invention, to make multi-color toner images, a single primary imaging member can be used to make each individual electrostatic image for each color separation and then the individual color toner images are transferred from the primary imaging member to the intermediate transfer member (ITM) 16 sequentially and in registration. The method comprises forming one electrostatic image on a primary imaging member corresponding to one color in the desired toner image; toning by applying the corresponding color marking toner particles to the electrostatic image to form an individual color toner image; and transferring the individual color toner image to the surface of an ITM in the presence of an electric field which urges the individual toner image toward the ITM and repeating the forming, toning and transferring steps for each color separation in a desired toner image.

In another embodiment, a single primary imaging member is used to make the individual electrostatic images for each color separation of a desired toner image, in registration, on top of each other on the primary imaging member. In this embodiment to create a multi-color image, at least two electrostatic images are formed and toned, sequentially, in registration on the same frame of the imaging member with marking toners of at least two different colors, and then the layers of the different marking toners are transferred simultaneously to an ITM in the presence of an electric field which urges the marking toner particles toward the ITM. This method is described in Gundlach, U.S. Pat. No. 4,078,929, incorporated herein by reference. Alternatively, more than one primary imaging member can be present in an apparatus to simultaneously form electrostatic images for the different color separations of one or more final toner images.

The apparatus of this invention can have any known means for establishing image-wise electrostatic charge on the primary imaging member(s). The most preferred means is to use a corona or roller charger to deposit a uniform electrostatic charge on primary imaging member(s), preferably photoconductive imaging member(s), and then to expose the photoconductive imaging member(s) to light from one or more exposing devices which reduces some of the charge on the photoconductive imaging member(s) to create an image-wise charge also referred to as an electrostatic image, sometimes referred to as an electrostatic latent image, on the photoconductive imaging member(s).

The apparatus of this invention has at least one development station for marking toner particles, also referred to as a "marking development station". An apparatus having one marking development station produces single color toner final images. An apparatus with multiple marking development stations for different color marking toners can be used to produce single color or multi-color final toner images. It is preferred that each marking development station has the capacity to create a voltage difference between the marking development station and the imaging member so that marking toner particles are urged to be attracted from the marking development station and electrostatically deposit and adhere to the imaging member to form a toned electrostatic image on the imaging member.

Preferably, the apparatus has a development station for non-marking toner particles, referred to as a "non-marking development station". It is preferred that the non-marking development station has the capacity to create a voltage difference between the non-marking development station and the imaging member so that non-marking toner particles are urged to be attracted from the non-marking development station to deposit and adhere to the imaging member or ITM. Various techniques for depositing both the marking and the non-marking toners from marking and non-marking development stations to a member may be used, preferably bias development stations. Examples include contact deposition, such as by using a magnetic brush, or non-contact deposition, such as by projection toning and powder cloud development.

An apparatus and method of the invention is illustrated in the printer apparatus 10 shown in FIG. 1, which includes one or more intermediate transfer member(s) (ITM) 16 to transfer a receiver R such as paper. One or more color toner images corresponding to one of the marking toners is transferred to the ITM from a primary imaging member 14, which may be a roller or a web but is preferably a roller. Subsequently, a second toner image corresponding to another of the marking toners is transferred to the ITM 16 (on top of and in registration with the first toner image) and so forth until a completed multicolor image stack has been transferred as needed to achieve the results desired.

Figure 2A:
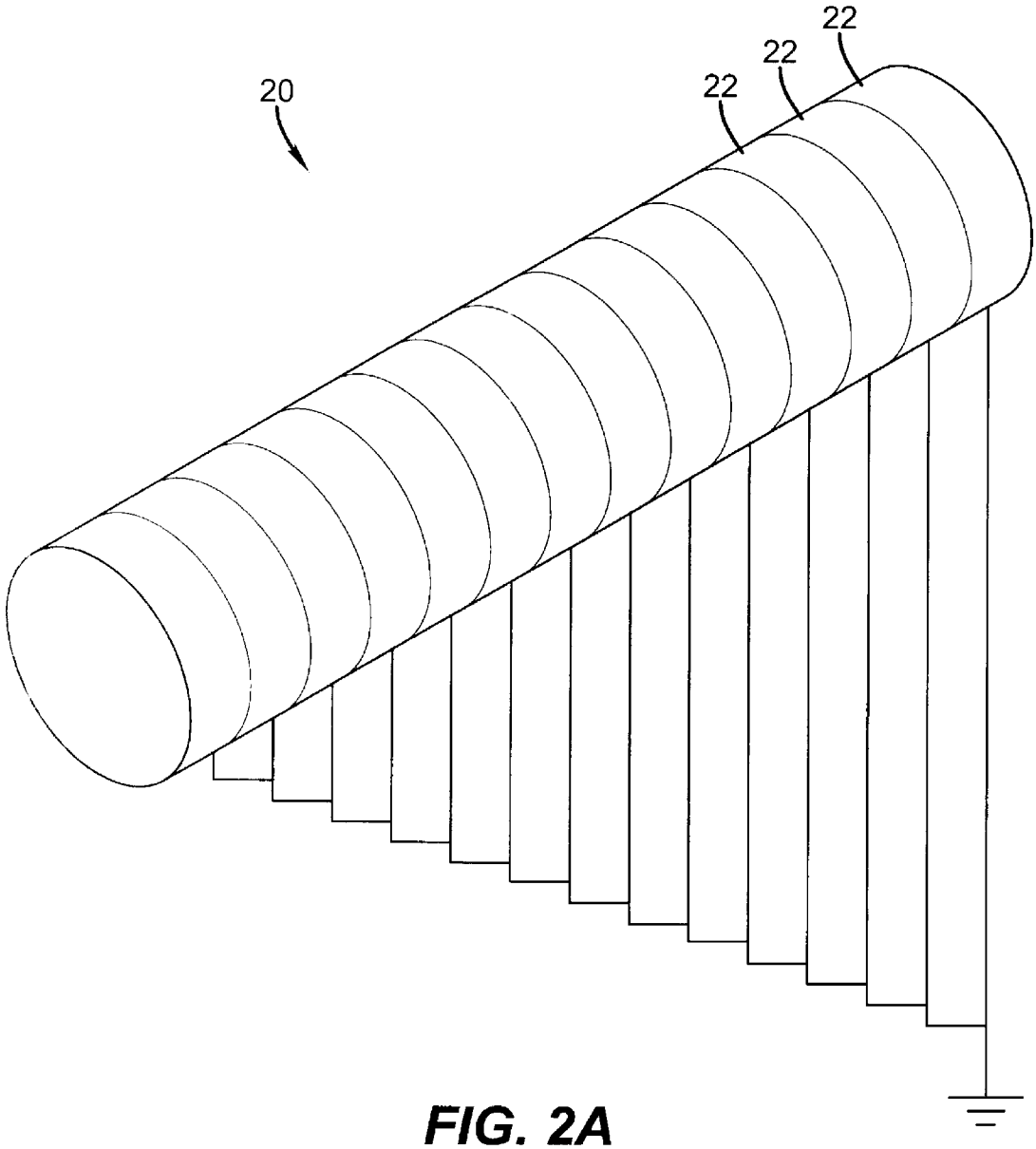
FIGS. 2*a* and 2*b* are perspective views of the segmented roller apparatus in accordance with an embodiment of the invention.
Figure 2B:
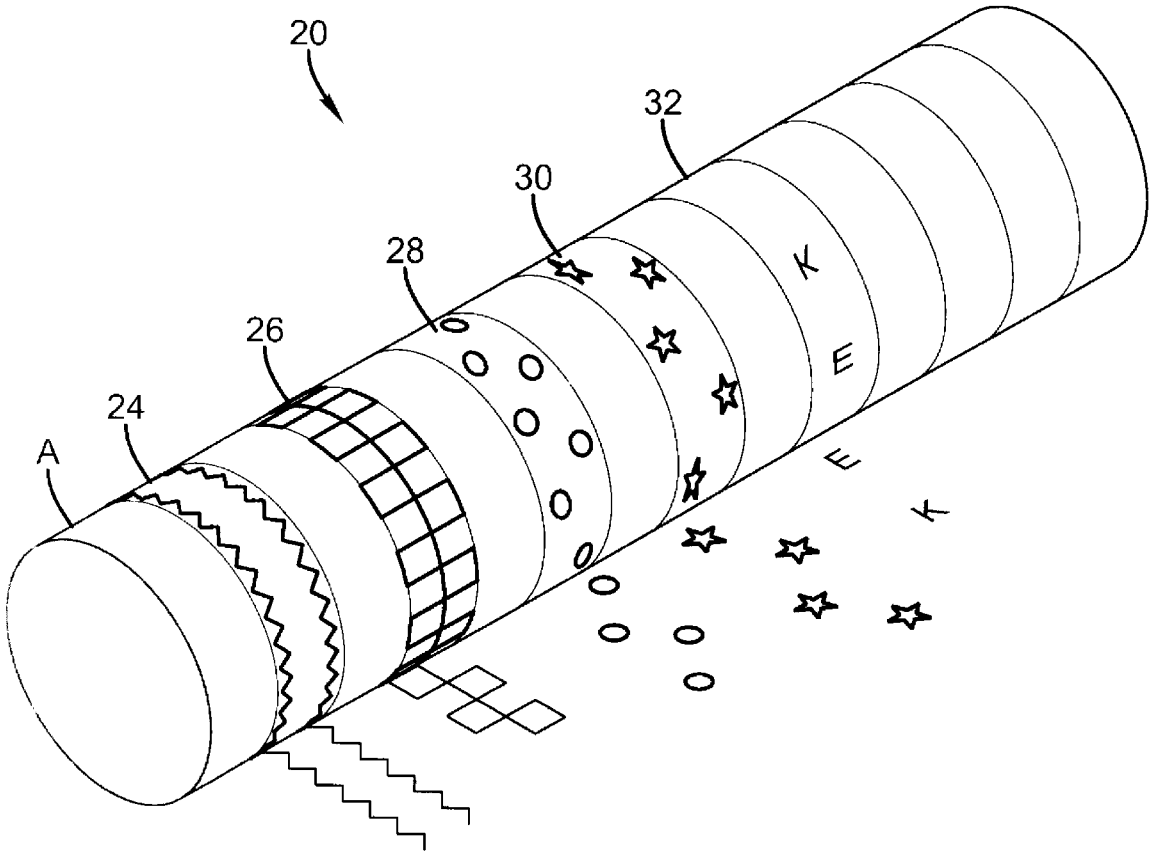

A segmented roller 20 is shown in FIGS. 2*a* and 2*b*. The segmented roller 20 has a number of segments 22 that can be of various shapes and widths as shown in FIG. 2*b* segments 24, and 26 for example. The segments of the segmented roller are electrically isolated from each other by an insulating material. The segmented roller may also include an outer layer, preferably an insulating or semi-insulating continuous layer that coats all of the segments and acts to limit electrical current flow between the segments and from the segments to other process elements. The layer also acts to smooth the deposition of toner in areas between segments when adjacent segments are activated. The segmented roller may also include one or more raised portions shown as dots, stars, snowflakes and/or indicia in segments 28, 30 and 32 respectively. One skilled in the art will understand that these could be used in any combination, alone or together as will be discussed in more detail below. The toner is moved by the rotating ITM as the receiver moves towards a final transfer station and then the toner is subsequently fixed or fused. The ITM 16 is cleaned of any residual clear toner at a cleaning station before another image is transferred to the ITM from the primary imaging member 14. The cleaning station includes, for example, a brush or skive blade that is movable into and out of engagement with the surface of ITM 16 at appropriate times in accordance with control signals provided by a logic and control unit (LCU) which includes one or more computers and input/output devices that control various operations as is well known in the copier/printer arts.

Figure 3:
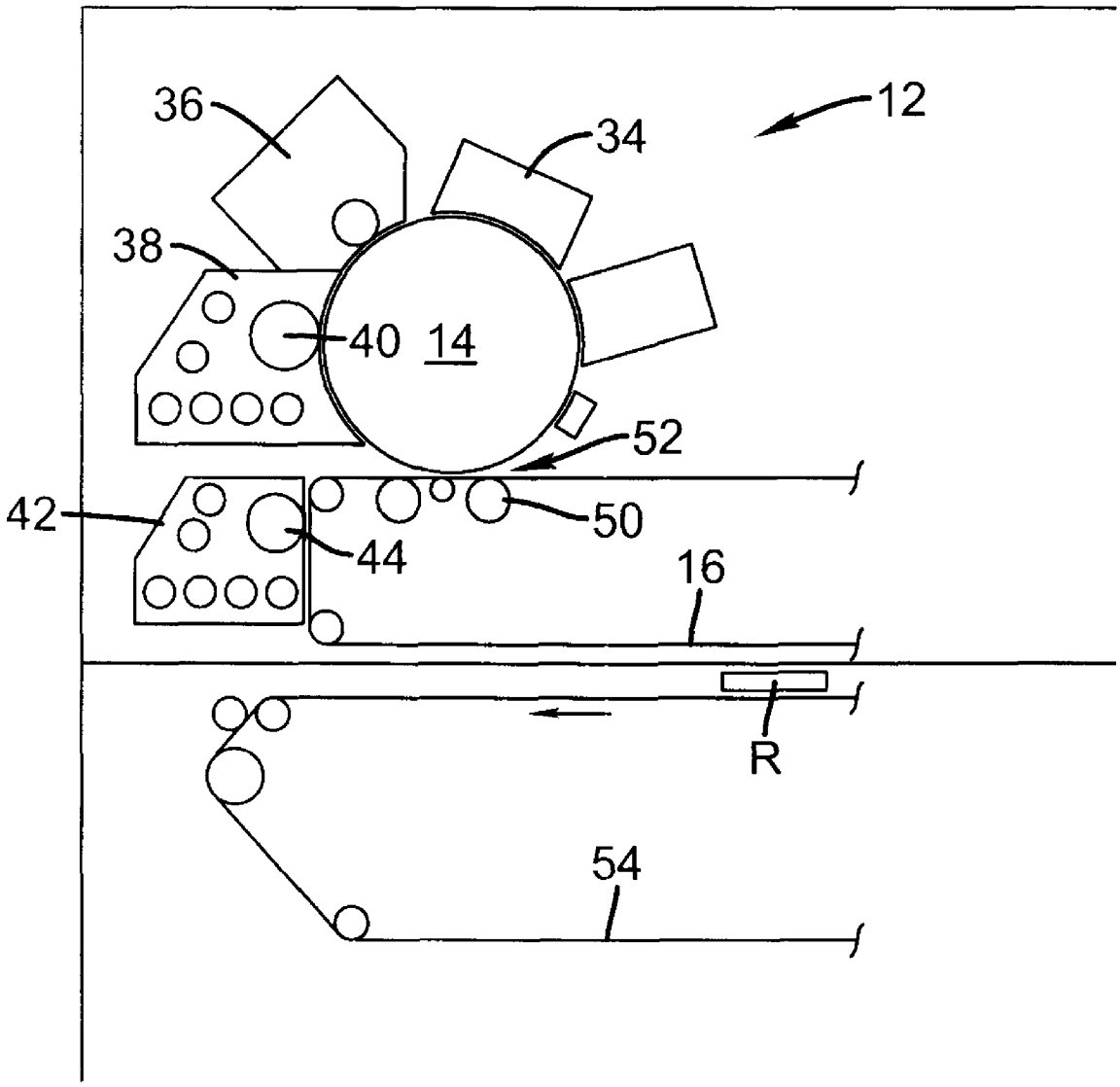
FIG. 3 is a schematic form of an electrophotographic recording apparatus according to the invention showing a portion of FIG. 1.

FIG. 3 illustrates one imaging module 12 shown alone for illustrative purposes. The primary imaging member 14 is preferably an electrophotoconductive member. A primary charger such as a corona charger 34 or other charge source provides a uniform electrostatic charge to the surface of member 14. An exposure source 36, either a laser or LED print head or other spatial light modulator, or an optical exposure source image-wise modulates light to form a latent or electrostatic image on the surface of member 14. Where the apparatus is a four-color "process" color printer, toner in the development stations is preferably black, cyan, magenta and yellow, respectively. The toner particles are preferably relatively small and have a particle size of between 2.mu.m and 9.mu.m. Each development station is preferably dry, i.e. non-liquid, and also preferably a two component development station using insulative toner particles and hard magnetic carrier particles, and of the "SPD type" which is described for example in an article by Edward T. Miskinis, entitled "Designing Materials For the KODAK COLOREDGE Copier Program published in IS&T's Sixth International Congress on Advances in Non-Impact Printing Technologies", Pages 101-110. However, other types of dry development may be used including single component development stations.

The non-marking development station or toning station 38 electrostatically charges the toner such as by tribocharging the color or insulative clear toner particles through rubbing with the carrier particles as is well known. An electrical bias is applied to the toner roller 40 which can be either the toning roller 40 in the toning station 38 or in a separate toning roller such as the one in the flood coating station 42 which also has a toning roller, hereafter referred to as a flood coating toning roller 44 for clear or non-marking toner. The segmented roller could also be in a completely separate location as will be discussed later.

The toning roller 40, which could be the segmented roller shown in FIG. 2, urges the toner to stick to the roller before the toner particles are moved to the ITM 16. The toner layer is preferably applied to the surface of the ITM 16 in a uniform layer or layers for example as monolayers. As the toner layer passes a nip between the ITM 16 and the primary imaging member 14, the electrical bias established by power supply (not shown) attracts a toner image developed from say the first developed color separation image (for example black) formed on the primary image forming member 14. Each color separation image is formed, as is well known, by establishing a uniform primary electrostatic charge on the surface of primary imaging member 14 by operating primary charger 34. The primary electrostatic charge is then image-wise modulated by light from the exposure source 36 in response to image data for each color separation page that controls light from exposure source 36. The black color separation image is developed with black toner from marking development station or toner station 38 using bias development. The black toner separation image is then electrostatically transferred under the electrical bias provided by power supply 36. Charger 34 then provides a uniform electrostatic charge. A cyan color separation image is then formed by image-wise exposure of the uniformly charged primary imaging member and developed using bias development at marking development station 38. The cyan toner image is then transferred to the ITM at the nip in superposed registered relationship with the black toner image on the ITM 16. The magenta and yellow color separation toner images are then similarly respectively formed through the respective similar process of cleaning the primary image member, uniformly charging the image member, exposing the respective color separation images, and bias developing the respective color separation images with respective colored toner particles and transferring the respective toner images in registered superposed relationship to the ITM so that up to four color separation images exist in superposed registered relationship upon the ITM and overlay the clear toner layer if desired.

As shown in FIG. 1, receiver sheet R is fed in suitable timed relationship as is well known, from a supply of receiver sheets. A logic and control unit (LCU), as is also well known, controls timing of the various components including a motor M which drives one or more of the mechanically driven members through suitable drive members not shown but selectable from those well known in the art. A transfer backing roller or member 50 is spring biased to apply pressure to the receiver sheet R in transfer nip 52. The transfer-backing roller 50 may comprise a conductive drum and an optional compliant blanket layer coating overlying the conductive drum. The conductive drum of the backing roller 50 is biased to a suitable potential (500-5000 volts) provided by power supply. The polarity of the power supply 42 is opposite to the polarity of the toner particle image on the ITM, so that the electric field in the transfer nip urges the clear toner layer and the multicolor toner image on the ITM to transfer to receiver sheet R.

The receiver sheet R, after transfer of the clear toner layer and the multicolor image thereto, is transported upon a belt 54 or other sheet conveyor to a fuser station 56 where the multicolor image is fixed by applying heat and pressure which causes the clear and colored toners to melt and adhere to the receiver sheet R. Thereafter, the cleaning member of cleaning station 58 engages the ITM 16 to clean the surface thereof so that the next layer of clear toner may be deposited thereon for the next image. It is important that the ITM 16 is cleaned of any residual clear toner at a cleaning station 58 before another image is transferred to the ITM from the primary imaging member 14. The cleaning station 58 includes, for example, a brush or skive blade that is movable into and out of engagement with the surface of ITM 16 at appropriate times in accordance with control signals provided by a logic and control unit (LCU) which includes one or more computers and input/output devices that control various operations as is well known in the copier/printer arts.

The segmented roller 20 shown in FIG. 2A can have one or more segments 22. As discussed above the segments 22 that can be of various shapes and widths and may include raised portions and an outer insulating or semi-insulating layer. The toner is moved by the rotating ITM to a final transfer station, where the toner is electrostatically transferred at a transfer nip 52 to the receiver R, such as paper, and subsequently fused as required using a variety of methods including those that are thermal and/or pressure operative including IR and UV.

The segmented roller 20 shown in FIG. 2A can have each segment 22 separately controllable to allow for bias development of a primary intermediate transfer member (ITM) only in areas that require the coating. In a first embodiment the segmented roller is the toning roller itself as shown in FIG. 3 and discussed above. In two examples of the first embodiment, as shown in FIGS. 1 and 2A the toning roller 40 and or the flood coat toning roller 44 is segmented. The segments 22 are separately biased as shown in FIG. 2A, so that the toner is deposited directly on to an ITM only in the areas that require the flood coat. The segments could also be biased in a related manner to create combinations of patterns.

Figure 4:
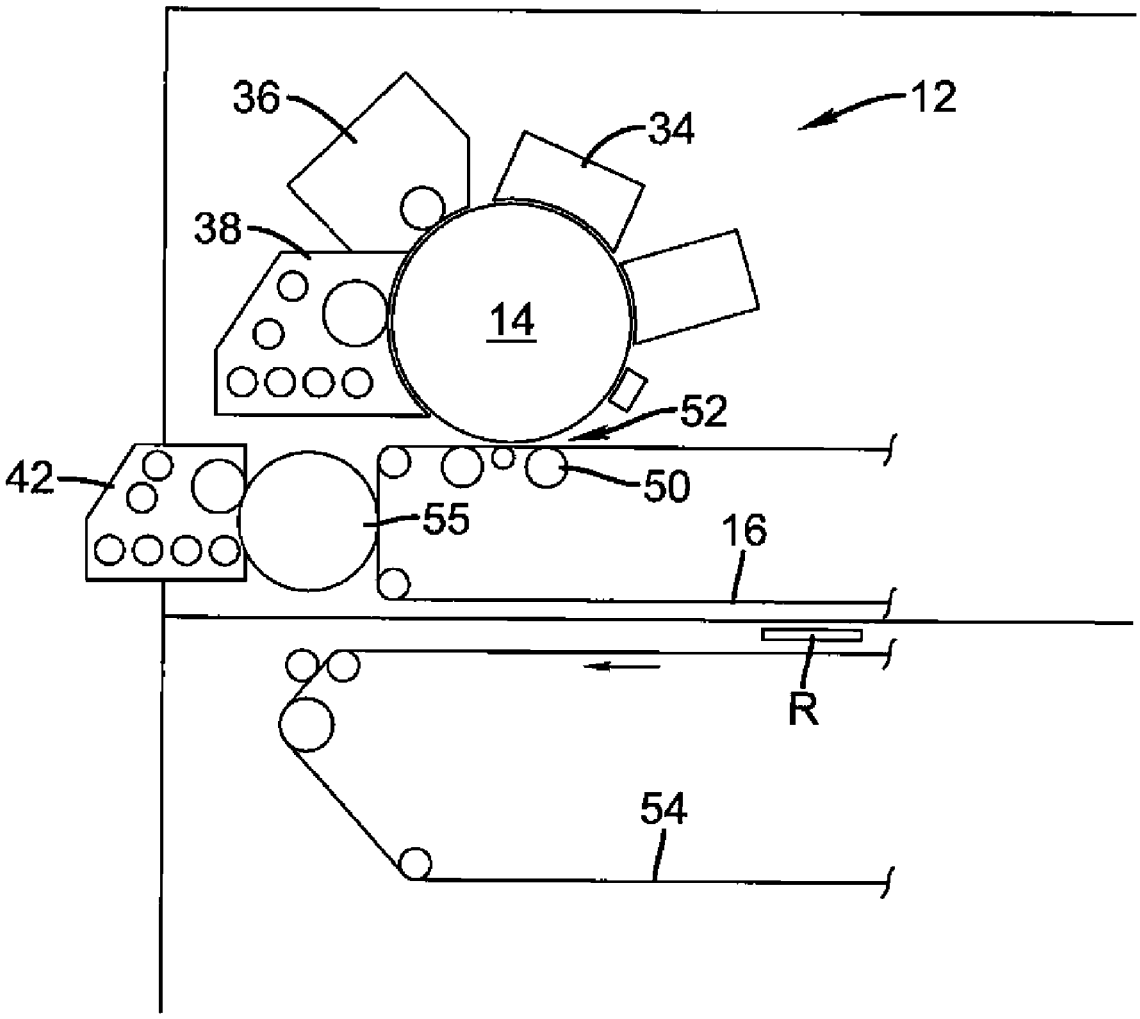
FIG. 4 is a side elevation view in schematic form of a portion of an electrophotographic recording apparatus and illustrating another exemplary embodiment of the invention.

In a second embodiment the segmented roller is a second roller 58 as shown in FIG. 4. In each embodiment the segments 22 are controlled so that toner is deposited on the intermediate transfer member 16 only in areas that require the flood coat or toner if used for color. The segments 22 are biased so that the toner is deposited first on to the segmented second roller 58, and then deposited on the primary ITM 16 only in the areas that require the flood coat or alternatively colored toner. The electrically controllable segments 22 eliminate the need for imaging elements such as a photoconductor, laser or LED, charger, and cleaner when a flood coat is desired.

In both embodiments discussed above the timing of the electrical signals to the individual segments 22 allows for spatial and temporal control of the toner deposition. Currently, flood coating of electrophotographic images are either done with a separate imaging unit or with a separate coating unit. For flood coating toning station on intermediates see U.S. Pat. Nos. 5,926,679; 5,794,111; 5,737,677, and 5,702,852.

FIG. 4 shows a schematic of an imaging apparatus having 5 imaging modules 12, and the ITM 16 in the form of an endless web. The flood coat toning station 42 in this embodiment could have a segmented roller 20 as discussed above.

FIG. 4 illustrates a preferred mode that uses a common toning station to the toning stations used in the imaging modules. Alternatively the toning station could deliver developer in the opposite direction compared to the toning stations in the imaging modules because the ITM 16 reverses the direction of the image. An alternative to the method shown in FIG. 4 is that discussed above in relation to FIG. 2, which includes using a segmented toning roller and a secondary roller containing no separate segments.

While the invention has been described with reference to color separation images, other types of color images such as accent color may also be produced and the apparatus may be operated in a single color mode. Also toners of the same color but different physical properties can be produced, for example, separate toner images of the same color but one being nonmagnetic while the other is magnetic may be combined in accordance with the above description of combining different color toner images.

In an embodiment wherein a clear (non-marking) toner layer is developed or otherwise first formed on a primary imaging member and a pigmented toner image is to be developed to form pictorial and textual information, the clear toner layer may be selectively deposited or formed in an area of an image frame corresponding to the location of the pictorial information. This may be accomplished by having an image processor analyze the image data for an image frame to determine if pictorial region(s) are present and to determine the border(s) of the pictorial information. Image processing circuits are well known for this type of analysis, some typically relying upon the image data for pictorial information having high frequency components. The image information representing the borders of the pictorial information may be used to create a bit map of the image area wherein data is provided for selectively actuating the segments of the segmented roller so that development of the clear toner layer selectively occurs at areas of the image frame corresponding to the pictorial information.

Another approach is to provide a criterion for selective deposition of the clear toner layer where multiple colors would tend to overlap since this presents the greater difficulty in transfer. The image analyzer would then compare where pixel locations in the different color separation image records tended to overlap or were relatively closely located and provide for an image data record of the clear toner image. The segments of the segmented roller would be activated where clear toner is to be developed since it corresponds to areas where multiple colors will be formed in the image prior to transfer to a receiver sheet.

The primary imaging member and the ITM may each be a web or drum. While the invention in the preferred embodiments describes forming an image on a primary imaging member that is a photoconductor, other types of electrostatographic recording are contemplated in the broader aspects of the invention. Thus, the primary imaging member may form electrostatic images using electrographic recording wherein charge is image-wise modulated and deposited on an electrographic recording medium using electrographic recording elements. The modulated charge is then developed with toner as described for recording using the electrophotoconductive processes described above.

In the various embodiments wherein different primary imaging members are provided in an embodiment, the various stations' positions and types may be optimized for best performance.

In addition, different types of say a cleaning station, for example, may be associated with different primary imaging members; i.e., one imaging member may have a brush cleaner and another a blade cleaner or combination blade plus brush cleaner. Where desirable in the various embodiments described, the transport support roller or cleaner may be moved out of engagement with a member carrying an image for the periods when the function of the roller or cleaner is not needed. If there is a need an additional optional cleaner may be inserter next to the segmented roller to enhance cleaning. The illustrated examples fire not shown to scale, particularly with regard to coatings in order to facilitate understanding of the invention.

The invention has been described in detail with particular reference to certain preferred embodiments thereof, but it will be understood that variations and modifications can be effected within the spirit and scope of the invention.

The invention claimed is:

1. An electrostatographic printing apparatus, the apparatus comprising:

an imaging member;

a development station for depositing toner upon the imaging member, said development station including a segmented roller, having two or more segments to control the depositing of toner to the imaging member on a segment by segment basis, to deposit at least a monolayer of toner to the imaging member in one or more areas of said imaging member in an image wise portion or in a non-image wise portion;

a controller for controlling an electrical bias to said development station wherein the controller separately controls an electrical bias to the segments of said segmented roller, wherein the deposition of the toner to the imaging member by said segments selectively includes an image wise portion and a non-image-wise portion; and a transfer station for transferring the toner image wise portion and any toner non-image-wise portion formed on said imaging member to a receiver sheet.

2. The apparatus of claim 1, the segmented roller including an outer layer, and said outer layer is insulating.

3. A coating apparatus, the apparatus comprising:

an imaging member;

a development station having one or more segmented rollers, each of said segmented rollers having two or more segments for depositing a layer of toner upon the imaging member on a segment by segment basis, wherein each of the one or more segments of the segmented rollers includes one or more raised areas;

a controller for controlling an electrical bias to said development station wherein the controller separately controls the electrical bias to the two or more segments of said segmented roller to control the transfer of toner to the imaging member in a segment by segment basis, wherein the deposition of the toner to the imaging member by said segments selectively includes an image wise portion and a non-image-wise portion; and a transfer station for transferring the toner image wise portion and any toner non-image-wise portion from said imaging member to a receiver sheet.

4. The coating apparatus of claim 3, wherein said controller further separately controls the electrical bias of the one or more segmented rollers to segment-wise combine the transfer of toner to the imaging member.

5. The coating apparatus of claim 3, the raised areas of said segmented rollers including a repeating pattern.

6. The coating apparatus of claim 3, wherein said segmented roller includes an insulating outer layer.

* * * * *